US011199054B1

(12) United States Patent
Choate

(10) Patent No.: US 11,199,054 B1
(45) **Date of Patent: *Dec. 14, 2021**

(54) WELL FRACTURING SYSTEM AND METHOD

(71) Applicant: Scott Choate, Austin, TX (US)

(72) Inventor: Scott Choate, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/080,473

(22) Filed: Oct. 26, 2020

(51) Int. Cl.

| | |
|---|---|
| ***E21B 17/02*** | (2006.01) |
| ***E21B 43/26*** | (2006.01) |
| ***E21B 43/12*** | (2006.01) |
| ***E21B 34/14*** | (2006.01) |

(52) U.S. Cl.
CPC ..... *E21B 17/02* (2013.01); *E21B 34/14* (2013.01); *E21B 43/12* (2013.01); *E21B 43/26* (2013.01); *E21B 43/2607* (2020.05)

(58) Field of Classification Search
CPC ..... E21B 17/02; E21B 43/2607; E21B 43/26; E21B 43/12; E21B 34/14
See application file for complete search history.

(56) References Cited

U.S. PATENT DOCUMENTS

| | | | | |
|---|---|---|---|---|
| 4,570,673 | A * | 2/1986 | Kendrick | E21B 21/02 137/615 |
| 8,839,867 | B2 | 9/2014 | Conrad | |
| 9,222,345 | B2 | 12/2015 | Conrad | |
| 9,255,469 | B2 | 2/2016 | Conrad | |
| 9,915,132 | B2 | 3/2018 | Conrad | |
| 10,385,662 | B2 | 8/2019 | Conard | |
| 10,774,965 | B1 * | 9/2020 | Travis | F16L 23/20 |
| 2011/0259584 | A1 * | 10/2011 | Broussard, II | E21B 43/26 166/271 |
| 2012/0242081 | A1 * | 9/2012 | Keays | F16L 27/053 285/145.3 |
| 2018/0073308 | A1 * | 3/2018 | Tran | E21B 33/068 |
| 2018/0347286 | A1 * | 12/2018 | Scott | E21B 17/05 |
| 2019/0071946 | A1 * | 3/2019 | Painter | E21B 21/02 |
| 2020/0217177 | A1 | 7/2020 | Conrad | |

* cited by examiner

*Primary Examiner* — James G Sayre

(57) ABSTRACT

A well fracturing system is provided. The well fracturing system includes an adjustable well fracturing manifold coupled to a plurality of well fracturing trees. The adjustable well fracturing manifold has fracturing fluid control units to control fluid flow, and fracturing fluid conduits that enable adjustments to the position of the adjustable well fracturing manifold. Further, the fracturing fluid conduit is composed of offset pipe sections coupled by connectors. The offset pipe sections are adjustable, allowing the offset pipe sections of the fracturing fluid conduit to vary a dimension of the fracturing fluid conduit to facilitate coupling of the adjustable well fracturing manifold between the well fracturing trees. Additional mechanisms, systems, and methods are also included.

17 Claims, 12 Drawing Sheets

WELL FRACTURING SYSTEM AND METHOD

BACKGROUND

The present disclosure relates in general to well fracturing systems used in oil and gas exploration and production operations and, in particular, to a well fracturing system that have a adjustable well fracturing manifold. Oil and gas exploration requires complex industrial equipment to be interconnected at a well site in a precise manner. Typically, a drilling rig and wellhead is connected to a pump of some type to drive drilling operations. A particular site may have numerous wells that are drilled. To improve production at these sites, fluids may be pumped down these wells to fracture subterranean rock layers and thereby free oil and natural gas. This process is commonly referred to as hydraulic fracturing. Hydraulic fracturing produces fractures in the rock formation that stimulate the flow of natural gas or oil, increasing the volumes that can be recovered from a well. Fractures are created by pumping large quantities of fluids at high pressure down a well and into the target rock formation.

Hydraulic fracturing requires specialized equipment to pump fluids, at varying pressures, to the wells. This is conventionally done by a pump supplying fracturing fluids to the wellhead for selective delivery down the well. The fluids are conveyed from pumps to wellheads using interconnected mechanical networks of piping, commonly referred to as fracturing fluid conduits. In essence, the fracturing fluid conduits must provide flow paths for varying degrees of pressurized fracturing fluids. Fracturing fluid commonly consists of sand or proppant, water, and chemical additives that open and enlarge fractures within the rock formation. These fractures can extend several hundred feet away from the well bore. The sand, proppant, acids, or other small incompressible particles, hold open the newly created fractures, so that oil and natural gas can be extracted from the fractures.

Additionally, the wellhead may use a fracturing tree and other components to facilitate a fracturing process and enhance production from a well. A fracturing flow control unit may provide control of fracturing fluid flow into one or more fracturing trees. The fracturing flow control units and fracturing tress are typically large and heavy, and may be mounted together at a fixed location, making adjustments in the fracturing manifold connected between the fracturing flow control units difficult. The present invention relates to a well fracturing system with an adjustable well fracturing manifold for use in hydraulic fracturing operations. For an example of an existing well fracturing system, see U.S. Pat. No. 10,385,662 which is herein incorporated by reference in its entirety.

Existing well fracturing systems do, however, have some problems. One problem with existing well fracturing systems is that they tend to utilize an adjustable well fracturing manifold having a fracturing fluid conduit where the conduit length is axially adjusted by an adjustment joint with a plurality of components using threaded parts, studs and nuts, and special sealing members to achieve a seal after the conduit adjustments are made. See, for example, the well fracturing system described in U.S. Pat. No. 8,839,867 (hereinafter the '867 patent), which is herein incorporated by reference in its entirety. The various threaded components, along with the studs and nuts used in the adjustment joints, are very time consuming adjustment mechanisms. Special sealing members are used to generate a seal once the conduit length is finalized. These special sealing members are expensive to manufacture, and in many cases, are not readily available.

Another problem with existing well fracturing systems is that they tend to utilize an adjustable well fracturing manifold having a fracturing fluid conduit that is adjusted by using a plurality of ball and socket joints. See, for example, the well fracturing system described in U.S. Pat. No. 9,222,345 (hereinafter the '345 patent), which is herein incorporated by reference in its entirety. These well fracturing systems have adjustable well fracturing manifolds with fracturing fluid conduits containing ball and socket joints having a large number of component parts. These ball and socket joints use customized sealing mechanisms that in most cases must be custom fit or lapped to the ball for high pressure sealing. These custom fit sealing members are expensive, time consuming to install, and are not readily available.

In addition to the above-mentioned problems, well fracturing systems can vary in quality in a number of ways. Different well fracturing systems vary in their ability to attain high flow coefficients of flow, their performance reliability, their durability, their cost to manufacture, and their ease of use.

SUMMARY OF THE INVENTION

Embodiments of the present disclosure generally relate to well fracturing systems having multiple fracturing trees coupled together by an adjustable well fracturing manifold consisting of fracturing flow control units and adjustable fracturing fluid conduits. In certain embodiments, an adjustable well fracturing manifold includes fracturing flow control units connected to one another via a fracturing fluid conduit between the fracturing flow control units. In some instances, the fracturing fluid conduit between the fracturing flow control units includes a large diameter bore pipe. The present disclosure generally relates to hydraulic fracturing using a well fracturing system with an adjustable well fracturing manifold that facilitates alignment and coupling of fracturing flow control units via a fracturing fluid conduit. The invented well fracturing system includes an adjustable well fracturing manifold having a fracturing fluid conduit consisting of a number of offset pipe sections with a number of angled connectors installed between each offset pipe section, wherein each offset pipe section has a primary bore connected to a secondary bore via an angled bore, and each offset pipe section is adjustable and provides freedom of movement in at least one direction in aligning the fracturing fluid conduit between the fracturing flow control units.

In one embodiment of the invention, a well fracturing system has multiple fracturing trees connected to an adjustable well fracturing manifold, wherein the adjustable well fracturing manifold has multiple fracturing flow control units with angled connectors coupled to fracturing fluid conduits having a plurality of offset pipe sections coupled together by a plurality of angled connectors, wherein each offset pipe section is adjustable and functions to provide freedom of movement to the fracturing fluid conduit. In another embodiment, a well fracturing system has multiple fracturing trees connected to an adjustable well fracturing manifold, wherein the adjustable well fracturing manifold has multiple fracturing flow control units with an angled connectors coupled to one end of fracturing fluid conduits. The other end of the fracturing fluid conduits are coupled to other fracturing flow control units. In another embodiment, a well fracturing system has multiple fracturing trees connected to an adjustable well fracturing manifold, wherein the adjustable well fracturing manifold includes a fracturing fluid conduit for coupling fracturing flow control units together with the use of a single shared connector or flow line.

A well fracturing system has been invented that addresses problems left unsolved by prior art well fracturing systems. Namely, a new well fracturing system having fracturing trees coupled to an adjustable well fracturing manifold has been invented that incorporates offset pipe sections into a fracturing fluid conduit, whereby adjustments to the offset pipe sections align the fracturing fluid conduit between fracturing flow control units of the adjustable well fracturing manifold. It has been discovered that a well fracturing system utilizing a fracturing fluid conduit composed of sections of offset pipe coupled together with angled connectors, can create an adjustable well fracturing manifold having few component parts while maintaining multiple directional freedoms of movement, along with a preferable means to adjust the fracturing fluid conduit between fracturing flow control units. A well fracturing system having an adjustable well fracturing manifold has been invented that utilizes components with a simple rotational means of directional adjustment, while incorporating readily available sealing members. Furthermore, a well fracturing system has been invented that requires few component parts having non-specialized sealing members to provide sealing between components. The present invention is a vast improvement over the well fracturing systems of the '867 and '345 patents.

In one aspect of the invention, an improved well fracturing system having fracturing trees coupled to an adjustable well fracturing manifold having fracturing fluid conduits connecting fracturing flow control units is provided. An improvement on the well fracturing system comprises the use of adjustable offset pipe sections that are coupled together with angled connectors in the form of a fracturing fluid conduit, wherein each offset pipe section provides freedom of movement in at least one direction. The novel use of multiple offset pipe sections, wherein each offset pipe section has a primary bore connected to a secondary bore via an angled bore, and with each offset pipe section providing freedom of movement in at least one direction in aligning the fracturing fluid conduit between fracturing flow control units of the adjustable well fracturing manifold.

In a second aspect of the invention, an improved well fracturing system is provided. The new invention removes the need to use complicated axial length adjustment joints with specialized sealing members in the fracturing fluid conduit of the adjustable well fracturing manifold. The improved invention uses a simple rotational adjustment means with readily available sealing members and standardized connections in the fracturing fluid conduit of the adjustable well fracturing manifold.

In a third aspect of the invention, an improved well fracturing system is provided, wherein the new invention reduces the total number of fracturing fluid conduit component parts required to achieve the freedom of movement necessary for aligning the fracturing fluid conduit with the fracturing flow control units mounted to fracturing trees. This is particularly important in operations involving multiple fracturing trees, since the new fracturing conduit will require multiples of fewer component parts. Fewer component parts used in the fracturing fluid conduit will reduce the time required to adjust, assemble, and disassemble the adjustable well fracturing system, resulting in less non-productive time, which increases the return on investment. Fewer fracturing fluid conduit component parts in the well fracturing system will also reduce the costs associated with shipping, storing, and moving the well fracturing system from one location to another.

The present invention provides the foregoing and other features, the advantage of the invention over prior art well fracturing systems does become further apparent from the following detailed description of the embodiments, read in conjunction with the accompanying drawings. The detailed description and drawings are merely illustrative of the invention and do not limit the scope of the invention, which is defined by the appended claims and equivalents thereof.

DETAILED DESCRIPTION SPECIFIC EMBODIMENTS

Figure 1:
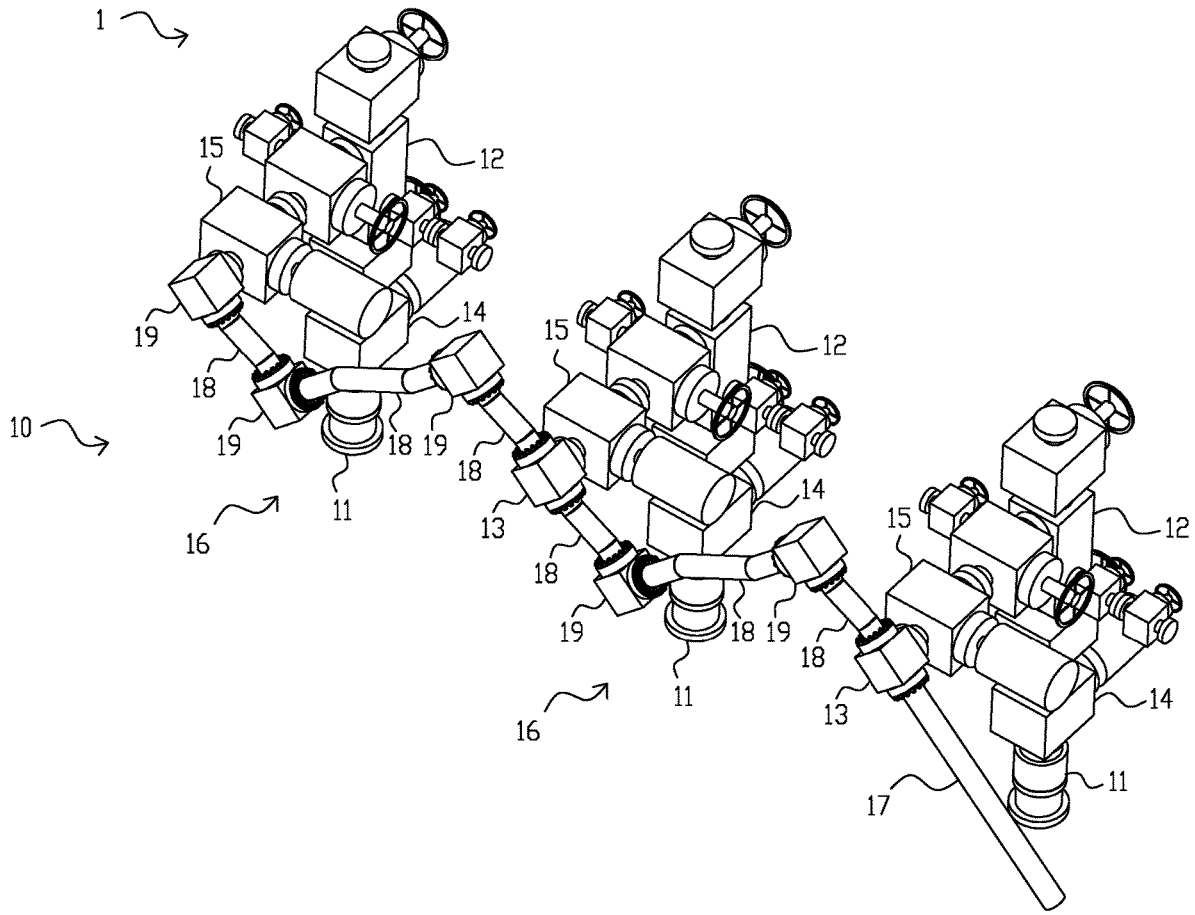
FIG. 1 is a perspective view of a well fracturing system having an adjustable well fracturing manifold with fracturing fluid conduits composed of offset pipe sections with threaded flange end connectors and angled connectors to connect between fracturing flow control units mounted on fracturing trees in accordance with an embodiment of the present disclosure.

An example of a well fracturing system 1 is provided in FIG. 1 in accordance with one embodiment. The well fracturing system 1 facilitates extraction of natural resources via a wellhead 11, a fracturing tree 12, and an adjustable well fracturing manifold 10. By injecting fracturing fluid through the fracturing tree 12 and wellhead 11, the adjustable well fracturing manifold 10 directs fracturing fluid to increase the number or size of fractures in a rock formation to enhance recovery of natural resources present in the formation. In the presently illustrated embodiment, the wellhead 11 is installed at the ground level, but it will be appreciated that natural resources may be extracted from other wellheads located on offshore platforms or on the sea floor.

In FIG. 1, the adjustable well fracturing manifold 10 includes various components to control flow of fracturing fluid into the wellhead 11. For instance, the adjustable well fracturing manifold 10 includes a fracturing tree 12 and a fracturing flow control unit 15. The fracturing flow control unit 15 controls flow of the fracturing fluid into the fracturing tree 12. The fracturing flow control unit 15 can contain one or multiple valves that controls the flow of the fracturing fluid to the fracturing tree 12 via an angled connector 19 or an angled flow tee 13 connected to a fracturing fluid conduit 16.

Referring to FIG. 1, multiple fracturing flow control units 15 are connected to multiple fracturing trees 12 and multiple wellheads 11. In one embodiment, the fracturing flow control unit 15 is mounted to a fracturing tree 12. The adjustable well fracturing manifold 10 is shown in which fracturing fluid conduits 16 are adjustable to facilitate coupling of the fracturing fluid conduits 16 between the fracturing flow control units 15 on the fracturing trees 12. In this embodiment, the adjustable components for the adjustable well fracturing manifold 10 are provided in the form of offset pipe sections 18 and angled connectors 19 of the fracturing fluid conduits 16. The ability to the offset pipe sections 18 of the fracturing fluid conduits 16 to provide directional movement to the offset pipe sections 18, while being individually rotated, enables the fracturing fluid conduits 16 to be more easily positioned and connected between the fracturing flow control units 15. In some instances, the offset pipe sections 18 and angled connectors 19 could be rotated to desired positions before assembling these components together. Although the offset pipe sections 18 are shown connected orthogonally to one another via the angled connectors 19 in the present embodiment, other embodiments could include offset pipe sections 18 connected to one another at different angles. In some instances, an angled tee connector 13 can be used to communicate fracturing fluid from the fracturing fluid conduit 16 to the fracturing flow control unit 15. A pipe extension 17 is connected to an angled tee connector 13 and can serve as the means for fracturing fluid to enter the adjustable well fracturing manifold 10. Other means of conveying fracturing fluid to the adjustable well fracturing manifold 10 could also be used in accordance with the present technique.

Figure 2:
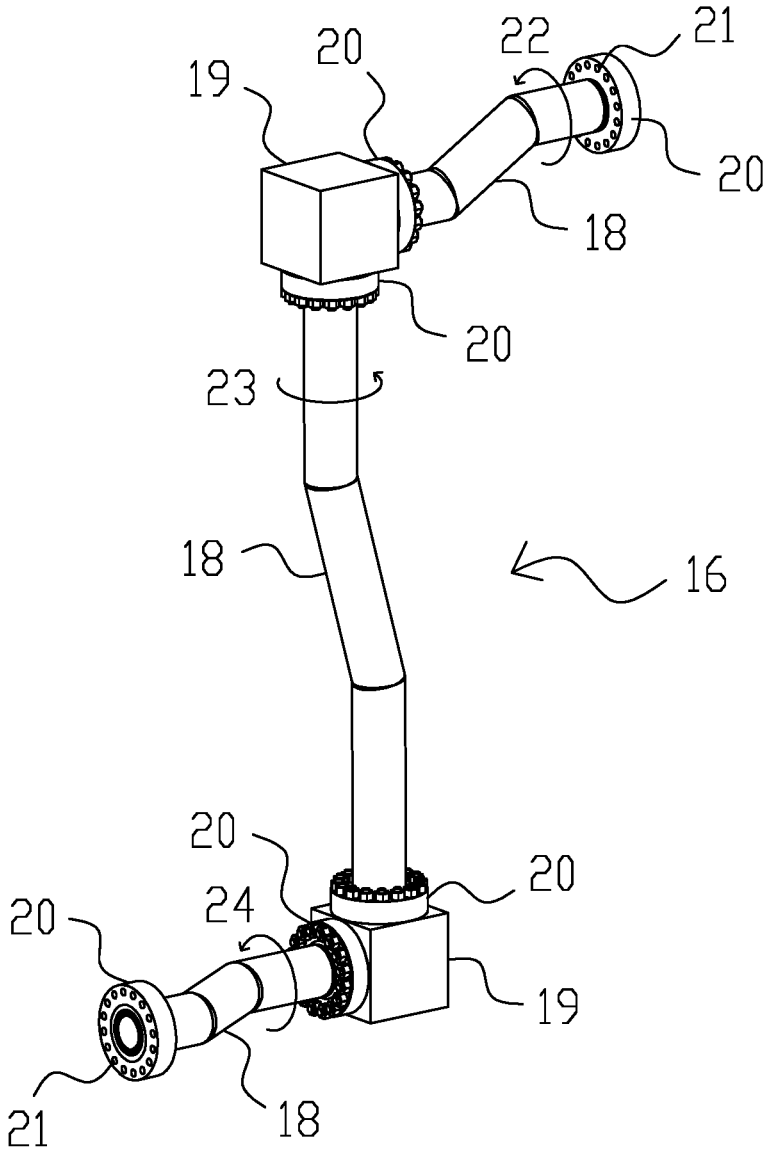
FIG. 2 is a perspective view of a fracturing fluid conduit composed of offset pipe sections with threaded flange end connectors and angled connectors, in accordance with an embodiment of the present disclosure.

Referring to FIG. 2, the fracturing fluid conduit 16 includes offset pipe sections 18 with threaded flange connectors 20 on each end that enables independent rotation of one offset pipe section 18 with respect to another offset pipe section 18. In this embodiment, the fracturing fluid conduit 16 includes a number of threaded flange connectors 20 that allow the offset pipe sections 18 and angled connectors 19 to rotate with respect to one another, which provides directional adjustment to the offset pipe sections 18 and thereby provides adjustment to the fracturing fluid conduit 16. As depicted, the threaded flange connectors 20 include through holes 21 to allow them to be connected to other components via studded connections. Other kinds of connections could also be used in accordance with the present technique. Various end connectors may be utilized with the offset pipe sections 18 in other embodiments.

Referring to FIG. 1 and FIG. 2, it can be seen that the threaded flange end connectors 20 enable the rotation of the offset pipe sections 18 and the angled connectors 19, as generally represented by arrows 22, 23, and 24. The threaded flange end connectors 20 at both ends of the offset pipe section 18 allows the offset pipe section 18 to be rotated about its primary bore axis, which causes movement of the secondary bore, which in turn changes the position of the angled connector 19. And through the rotation of the offset pipe sections 18, overall dimensions of the fracturing fluid conduit 16 can be changed to accommodate variances in distances and elevations between the fracturing flow control units 15. By rotating the various offset pipe sections 18 of the fracturing fluid conduit 16, the offset pipe sections 18 may be extended and retracted to position the fracturing fluid conduit 16 appropriately for coupling between the fracturing flow control units 15.

Figure 3:
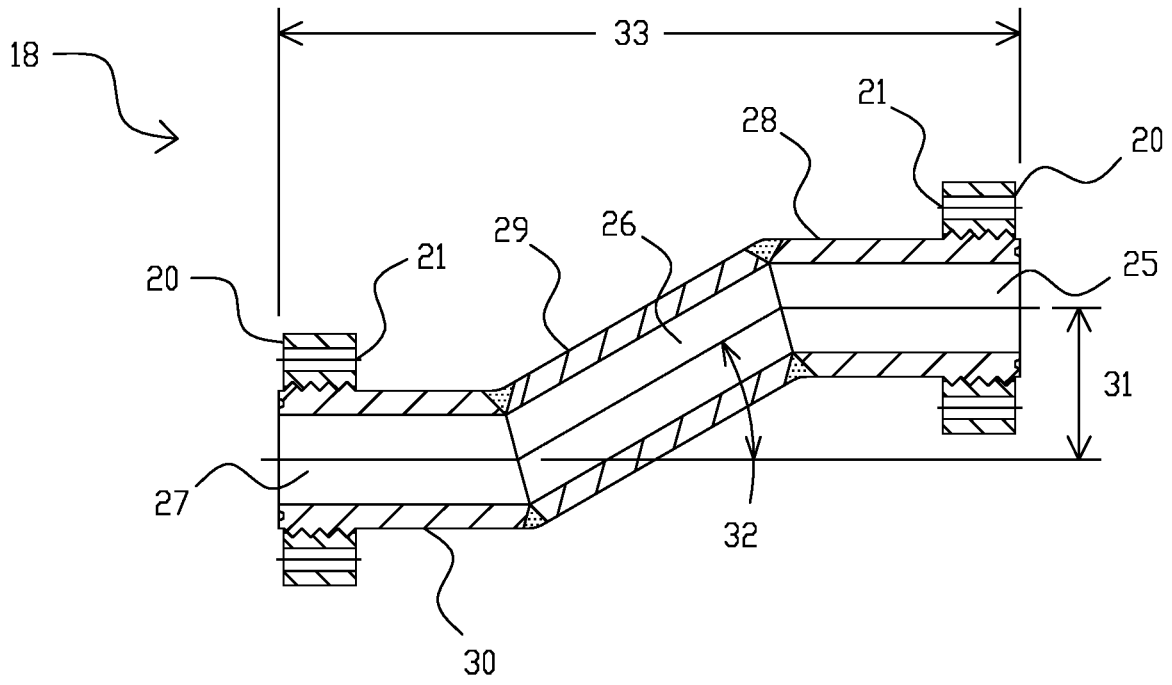
FIG. 3 is a cross sectional view of an offset pipe section with a threaded flange connector on each end, in accordance with an embodiment of the present disclosure.

Referring to FIG. 3, a cross sectional view of an offset pipe section 18 is shown with threaded flange end connectors 20 having through holes 21 on each end. The offset pipe section 18 is composed of a primary hub 28 connected to an angled pipe 29, which is connected to a secondary hub 30. Those of ordinary skill in the art understand the various ways of bending pipe to obtain an offset conduit or assembling a conduit by connecting the primary hub 28 to the angled pipe 29, and the angled pipe 29 to the secondary hub 30. For means of illustration only, the means of connection between components shown are weldments. Fracturing fluid flows through the offset pipe section 18 by entering a primary bore 25 of the primary hub 28, then the fracturing fluid enters an angled bore 26 of the angled pipe 29, then the fracturing fluid enters the secondary bore 27 of the secondary hub 30, and then the fracturing fluid exits the offset pipe section 18. The offset pipe section 18 has an overall length 33 with an offset angle 32 and an offset distance 31. The offset angle 32 is determined by the angle created between the secondary bore 27 centerline axis and the angled bore 26 centerline axis. The offset distance 31 is determined by the distance from the primary bore 25 centerline axis to the secondary bore 27 centerline axis. It should be noted that in order to achieve a reasonable amount of offset pipe section 18 adjustment, only a small offset angle 32 is required when coupled with the overall length 33. A small offset angle 32 will lessen the disruption of the fracturing fluid flow path and reduce erosion thorough the offset pipe section 18.

Figure 4C:
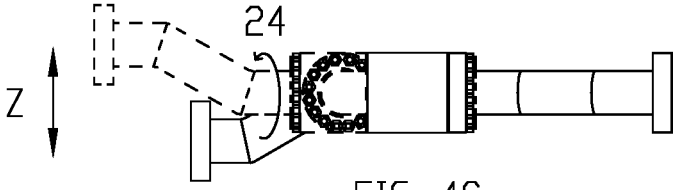
FIG. 4 shows various views of a fracturing fluid conduit composed of offset pipe sections with threaded flange end connectors and angled connectors showing directional movements resulting from offset pipe section rotations, in accordance with an embodiment of the present disclosure.
Figure 4B:
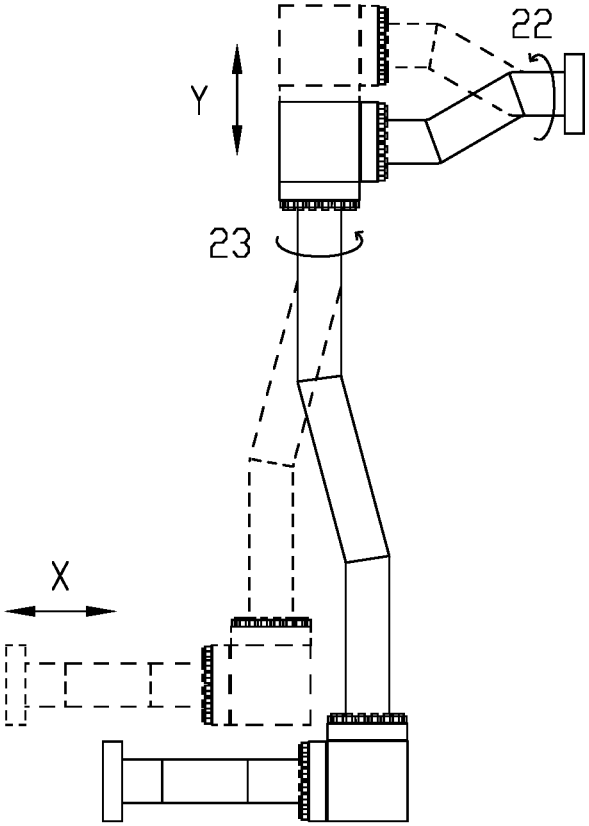
Figure 4A:
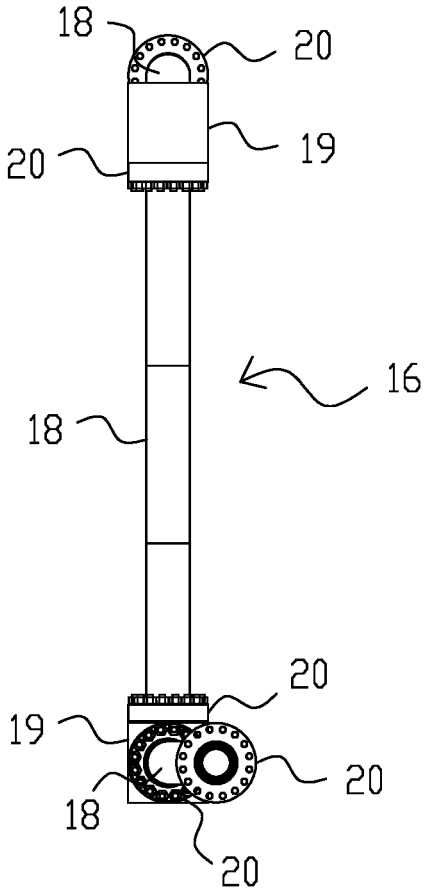

Referring to FIG. 4A, a front view of the fracturing fluid conduit 16 is shown. Referring to FIG. 4B, a side view of the fracturing fluid conduit 16 is shown. Referring to FIG. 4C, a top view of the fracturing fluid conduit 16 is shown. Referring to FIG. 4A, the fracturing fluid conduit 16 is composed of offset pipe sections 18 with threaded flange end connectors 20 and angled connectors 19. Adjustments to the fracturing fluid conduit 16 are accomplished by rotating a particular offset pipe section 18, which produces a desired directional movement in the offset pipe section 18. Referring to FIG. 4B, rotation 22 produces a Y direction movement in the fracturing fluid conduit 16. Rotation 23 produces a X direction movement to the fracturing fluid conduit 16. Referring to FIG. 4C, rotation 24 produces a Z direction movement. Note that the directions stated previously are for illustrative purposes only. A particular rotation can provide more than one particular direction of movement. For example, rotation 22 can also produce movement in the Z direction, rotation 23 can also produce movement in the Z direction, and rotation 24 can also produce movement in the Y direction. Any combination of rotations can be used to create the desired movement of the fracturing fluid conduit 16.

Figure 5:
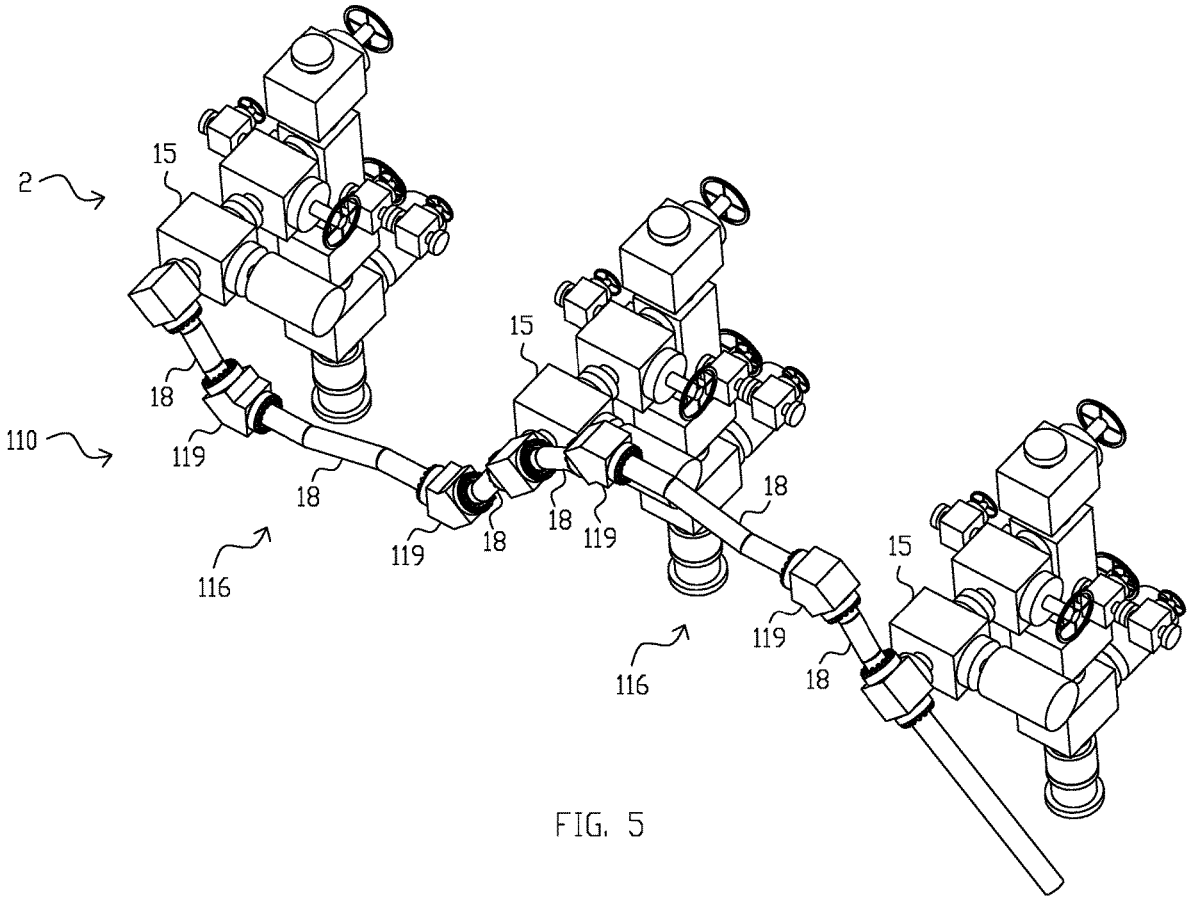
FIG. 5 is a perspective view of a well fracturing system having an adjustable well fracturing manifold with fracturing fluid conduits composed of offset pipe sections with threaded flange end connectors and angled connectors and angled tee connectors to connect between fracturing flow control units mounted on fracturing trees, in accordance with an embodiment of the present disclosure.

Referring to FIG. 5, in this embodiment the well fracturing system 2 is substantially identical to the well fracturing system 1 in FIG. 1, except the adjustable well fracturing manifold 110 of the well fracturing system 2 includes fracturing fluid conduits 116 with a number of 135 degree angled connectors 119 that couple the offset pipe sections 18 together. The offset pipe sections 18 can be rotated with respect to one another, which provides directional movement to the offset pipe sections 18 and thereby provides adjustment to the fracturing fluid conduit 116 to couple the fracturing flow control units 15 together. The use of a number of 135 degree angled connectors 119 in the fracturing fluid conduit 116 increases the flow efficiency of fracturing fluid through the fracturing fluid conduit 116, resulting in reduced erosion on component parts due to the removal of any ninety degree directional changes in the fracturing fluid conduit 116.

Figure 6:
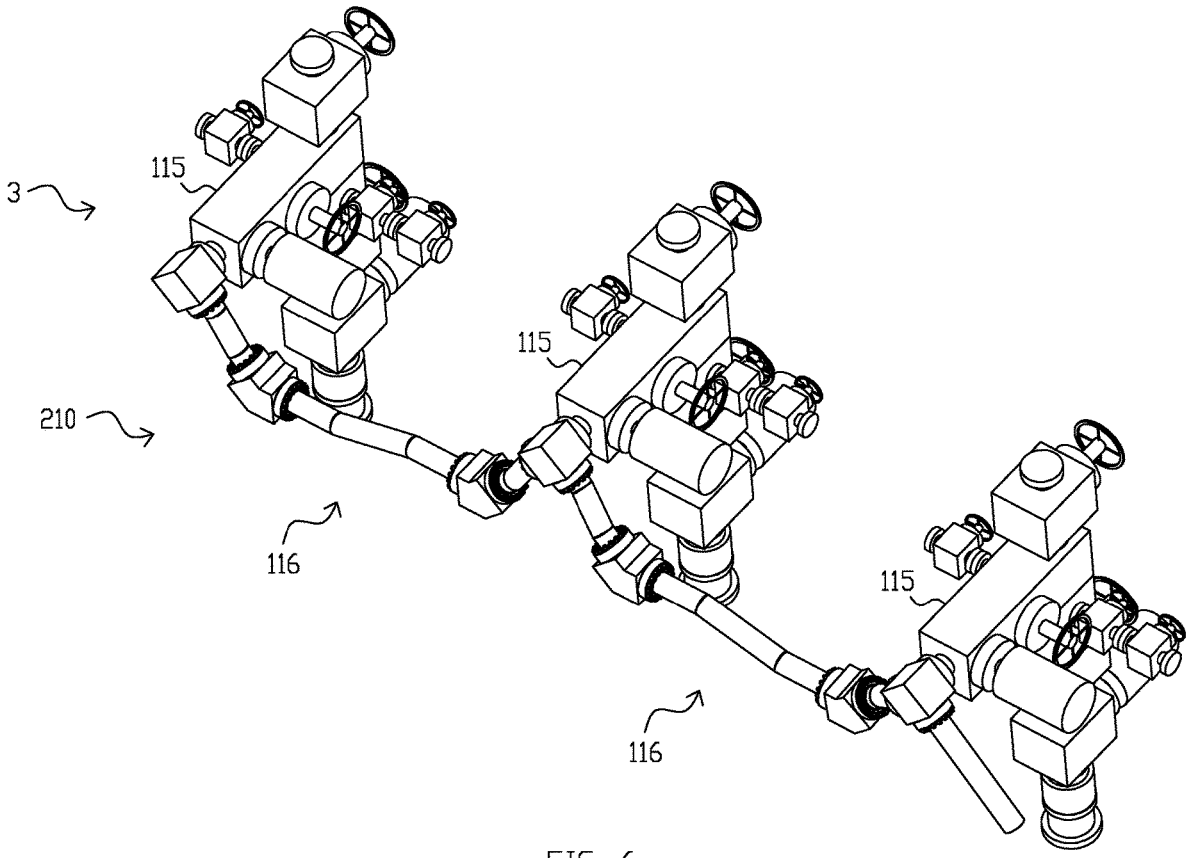
FIG. 6 is a perspective view of a well fracturing system having an adjustable well fracturing manifold with fracturing fluid conduits composed of offset pipe sections with threaded flange end connectors and angled connectors and two angled tee connectors to connect between integrated fracturing head flow control units, in accordance with an embodiment of the present disclosure.

Referring to FIG. 6, in this embodiment the well fracturing system 3 is substantially identical to the well fracturing system 2 in FIG. 2, except the adjustable well fracturing manifold 210 of the well fracturing system 3 utilizes integrated fracturing head flow control units 115 with two fracturing fluid conduits 116 placed below the integrated fracturing head flow control units 115. The fracturing flow conduits 116 are connected between integrated fracturing head flow control units 115 to provide communication for fracturing fluid to each integrated fracturing head flow control unit 115 via the fracturing fluid conduit 116.

Figure 7:
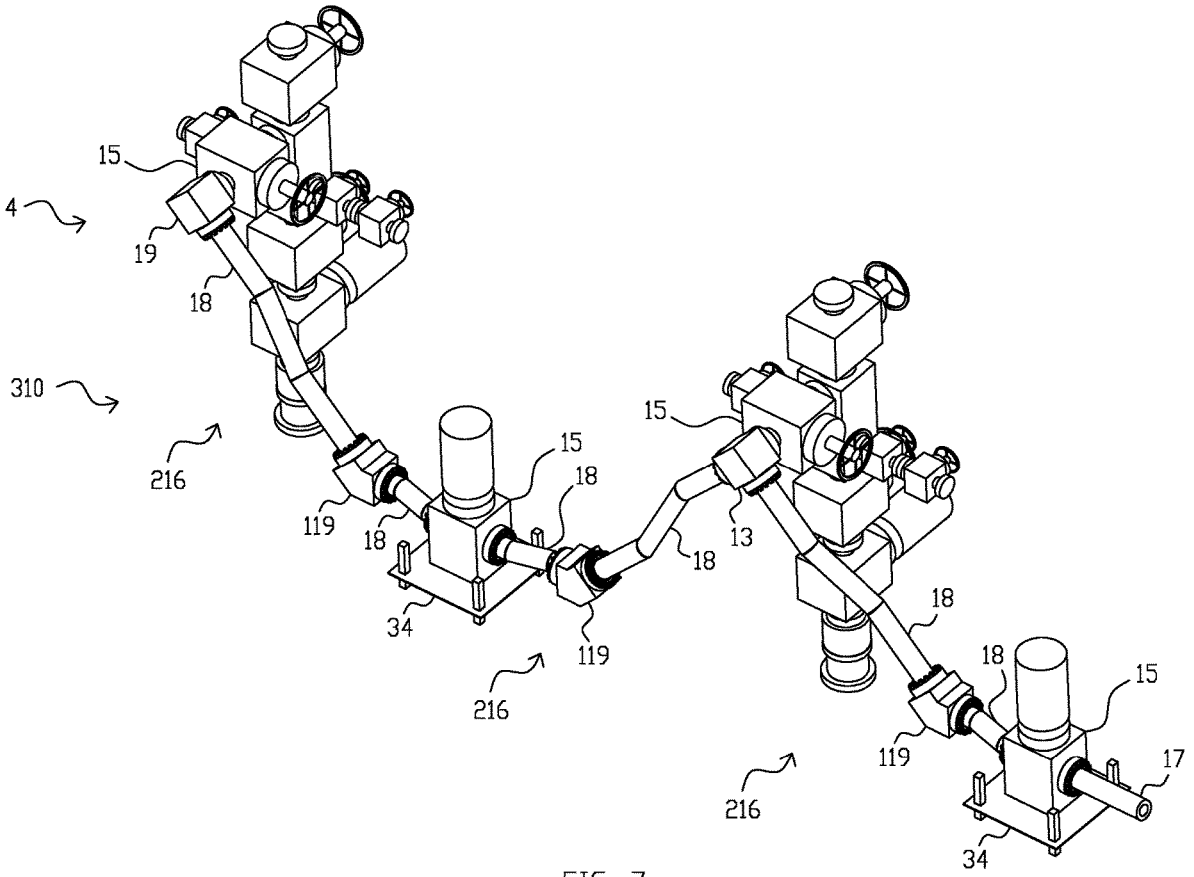
FIG. 7 is a perspective view of a well fracturing system having an adjustable well fracturing manifold using fracturing fluid conduits composed of offset pipe sections with threaded flange end connectors and angled connectors and one angled tee connector to connect between fracturing flow control units, in accordance with an embodiment of the present disclosure.

Referring to FIG. 7, in this embodiment the well fracturing system 4 with an adjustable well fracturing manifold 310 utilizes an angled connector 19 connected to a fracturing fluid conduit 216 consisting of two offset pipe sections 18 coupled by a 135 degree angled connector 119. The fracturing fluid conduits 216 are adjustable to facilitate coupling of the fracturing fluid conduits 216 between the fracturing flow control units 15 and are utilized to provide flow communication between fracturing fluid flow control units 15. The adjustable well fracturing manifold 310 can also utilize an angled tee connector 13 to connect the fracturing fluid flow control unit 15 to the fracturing fluid conduit 216. Fracturing flow control units 15 at ground level are mounted at opposite ends of the fracturing fluid conduit 216, and can be mounted on height adjustable platforms 34, but this is optional. A pipe extension 17 is connected to one fracturing flow control unit 15 and can serve as the means for fracturing fluid to enter the well fracturing system 4.

Figure 8:
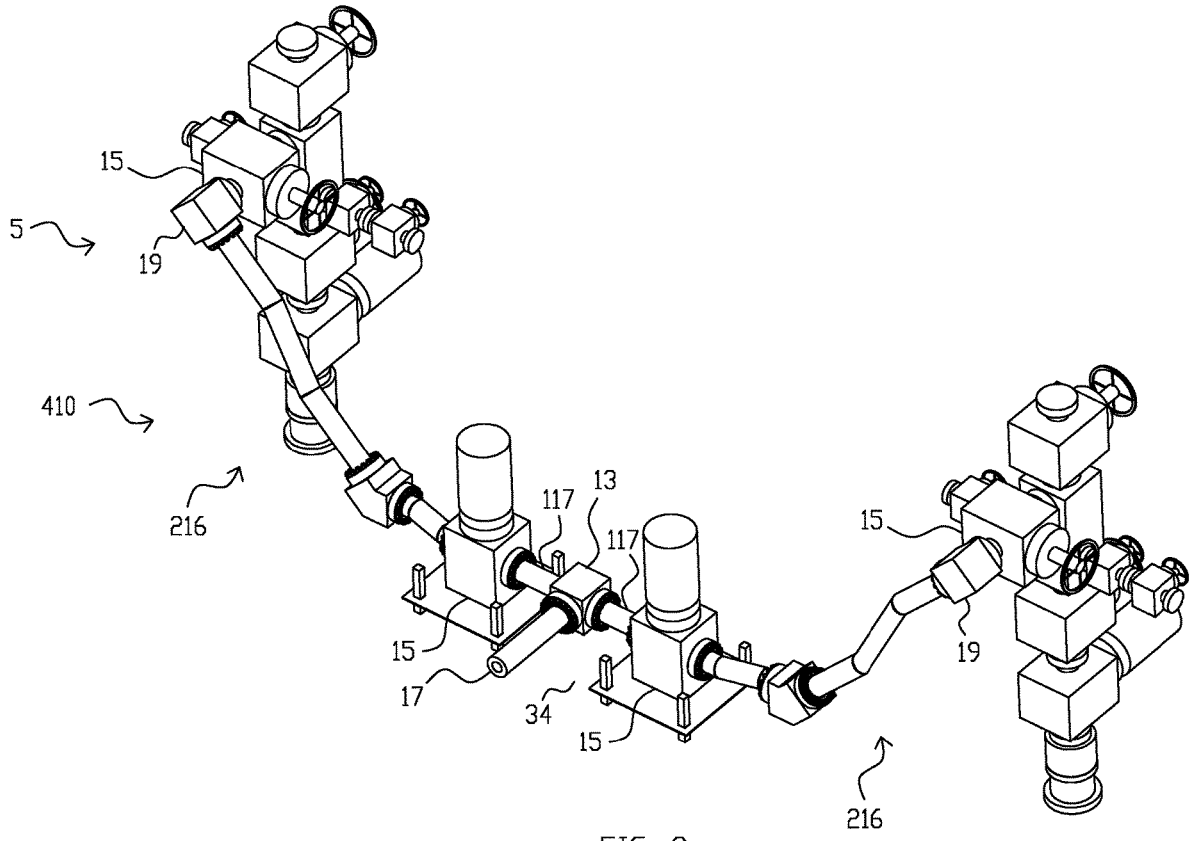
FIG. 8 is a perspective view of a well fracturing system having an adjustable well fracturing manifold with fracturing fluid conduits composed of offset pipe sections with threaded flange end connectors and angled connectors to connect between fracturing flow control units and having one angled tee connector between fracturing flow control units, in accordance with an embodiment of the present disclosure.

Referring to FIG. 8, in this embodiment the well fracturing system 5 is substantially identical to the well fracturing system 4 in FIG. 7, except the well fracturing system 5 with an adjustable well fracturing manifold 410 utilizes a pipe extension 17 connected to an angled tee connector 13, whereby the angled tee connector 13 is coupled to opposing pipe extensions 117, each opposing pipe extension 117 is connected to a fracturing flow control unit 15. The fracturing flow control units 15 have fracturing fluid conduits 216 on the side opposite the opposing pipe extensions 117. The fracturing fluid conduits 216 with angled connectors 19 are utilized to provide communication between fracturing fluid flow control units 15. The pipe extension 17 can serve as the means for fracturing fluid to enter the well fracturing system 5.

Figure 9:
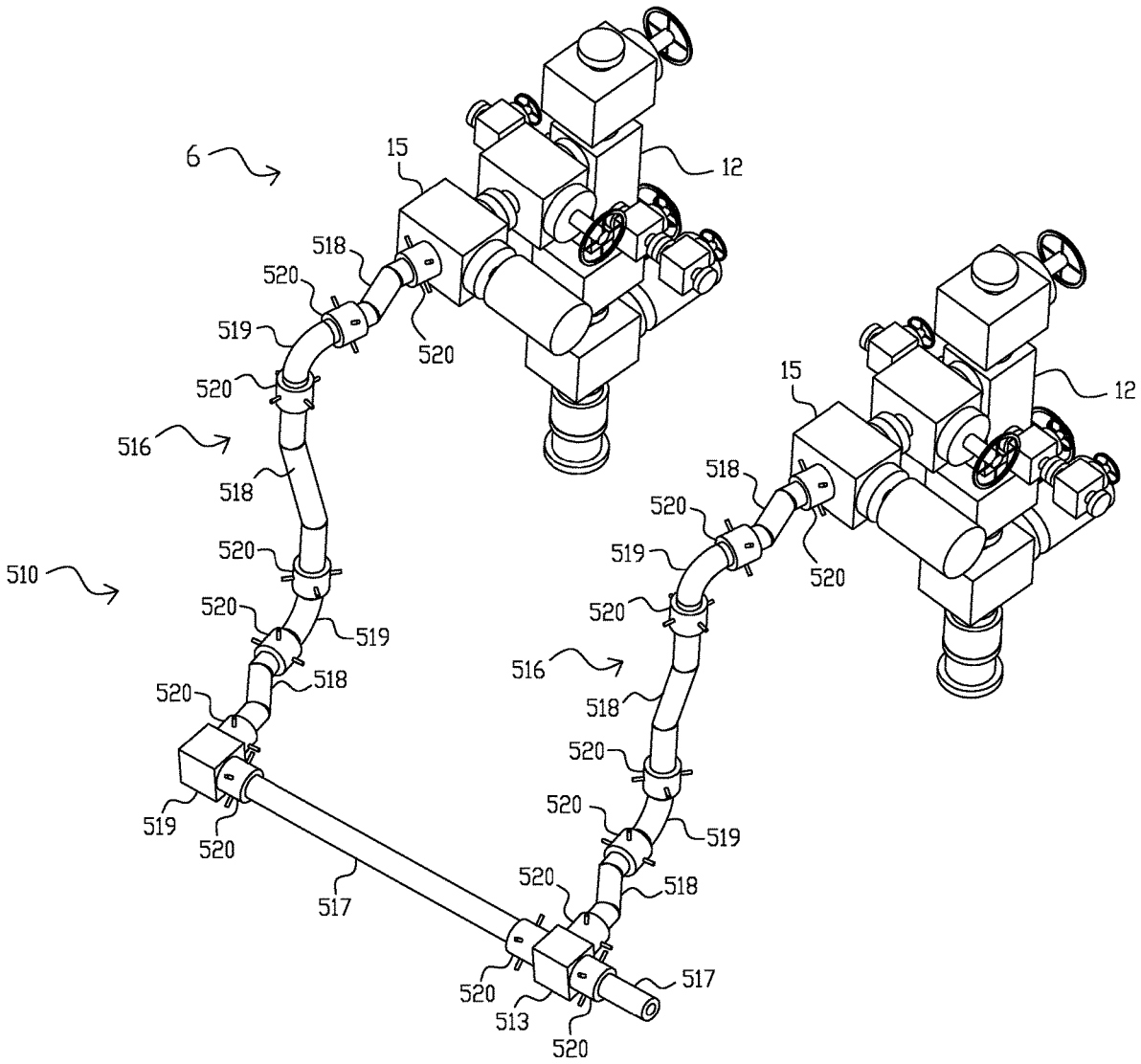
FIG. 9 is a perspective view of a well fracturing system having an adjustable well fracturing manifold with fracturing fluid conduits composed of offset pipe sections with threaded end connectors and threaded angled connectors to connect fracturing flow control units via a shared threaded pipe connector with threaded angled connectors at each end, in accordance with an embodiment of the present disclosure.

Referring to FIG. 9, in this embodiment the well fracturing system 6 with an adjustable well fracturing manifold 510 is shown in which fracturing fluid conduits 516 are adjustable to facilitate coupling of the fracturing fluid conduits 516 between the fracturing flow control units 15 on the fracturing trees 12. The adjustable components for the adjustable well fracturing manifold 510 are provided in the form of offset pipe sections 518 having threaded union end connectors 520 at each end and threaded union angled connectors 519 composing the fracturing fluid conduits 516. The ability to the offset pipe sections 518 of the fracturing fluid conduits 516 to provide directional movement to the offset pipe sections 518, while being individually rotated, enables the fracturing fluid conduits 516 to be more easily positioned. In this embodiment, one fracturing fluid conduit 516 is connected to an angled connector 519, and one fracturing fluid conduit 516 is connected to an angled tee connector 513. A pipe extension 517 with threaded union connectors 520 at each end couples the angled connector 519 to the angled tee connector 513. A pipe extension 517 with a threaded union connector 520 on the opposing side of the angled tee connector 513 can be used to introduce fracturing fluid into the well fracturing system 6.

Figure 10:
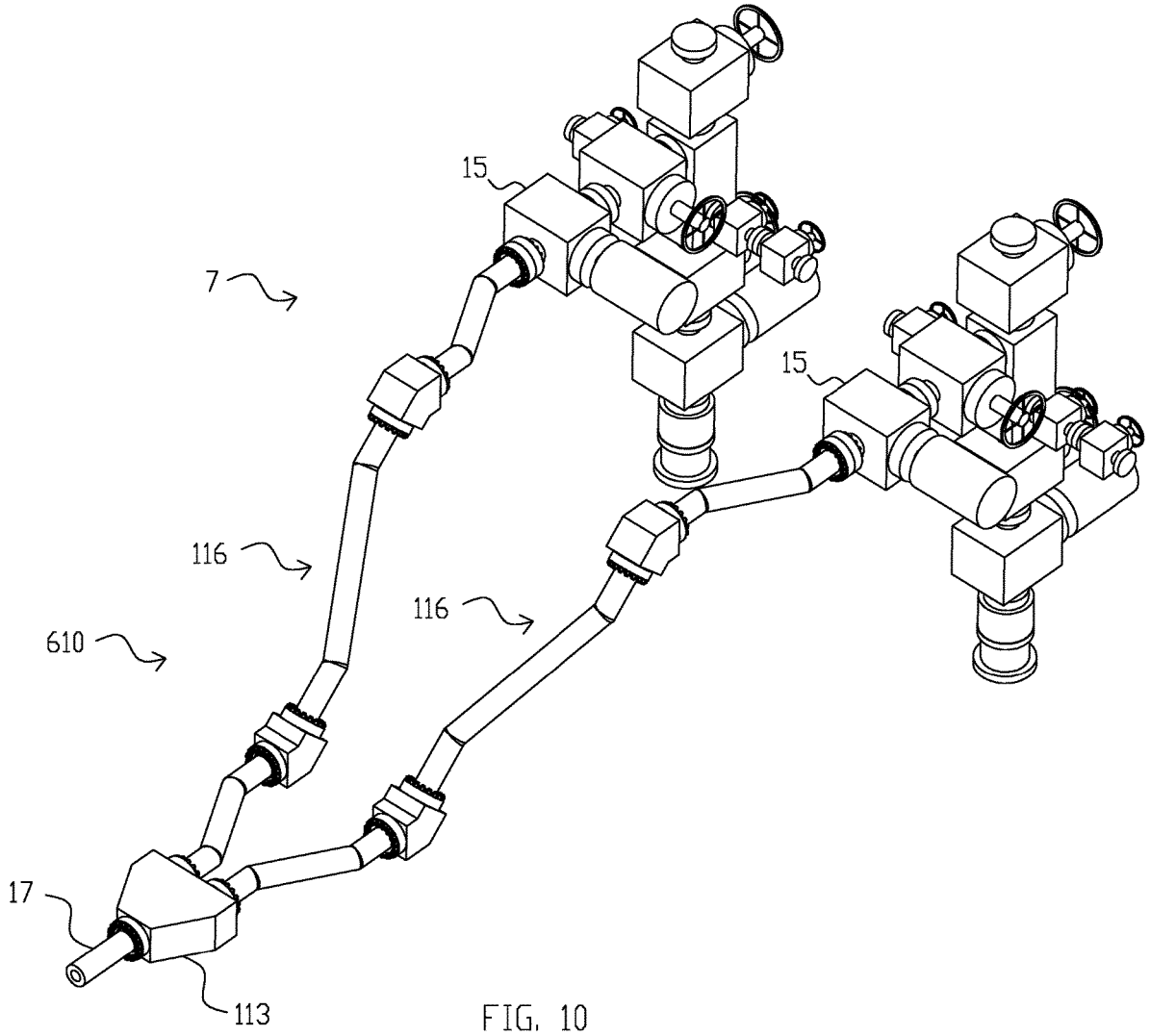
FIG. 10 is a perspective view of a well fracturing system having an adjustable well fracturing manifold with fracturing fluid conduits composed of offset pipe sections with threaded flange end connectors and angled connectors to connect fracturing flow control units via a single connector, in accordance with an embodiment of the present disclosure.

Referring to FIG. 10, in this embodiment the well fracturing system 7 with adjustable well fracturing manifold 610 utilizes the same fracturing fluid conduits 116 as the well fracturing system 3 in FIG. 6, except the adjustable well fracturing manifold 610 utilizes a fracturing flow control unit 15 connected to a fracturing fluid conduit 116 which connects to a single block connector 113. The single block connector 113 has a pipe extension 17 connected on the side opposing the fracturing fluid conduit 116. The single block connector 113 serves to provide communication between the fracturing fluid conduits 116 and their respective fracturing fluid flow control units 15. The single block connector 113 shown has two connections, but more connections can be utilized in other embodiments.

Figure 11:
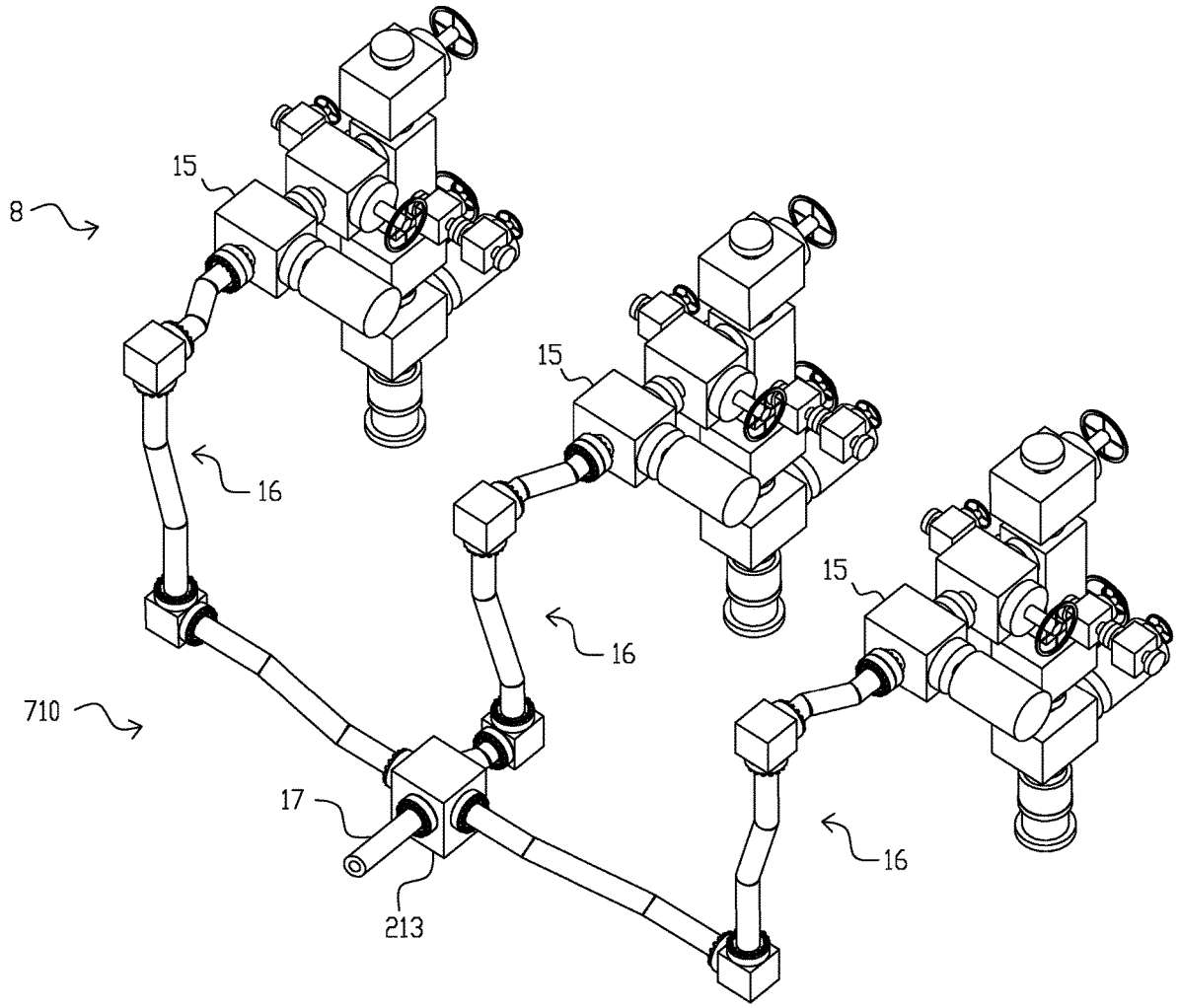
FIG. 11 is a perspective view of a well fracturing system having an adjustable well fracturing manifold with fracturing fluid conduits composed of offset pipe sections with threaded flange end connectors and angled connectors to connect fracturing flow control units via a single connector, in accordance with an embodiment of the present disclosure.

Referring to FIG. 11, in this embodiment the well fracturing system 8 utilizes the same fracturing fluid conduits 16 as the well fracturing system 1 in FIG. 1, except the adjustable well fracturing manifold 710 utilizes a fracturing flow control unit 15 connected to a fracturing fluid conduit 16 which connects to a cross connector 213. The cross connector 213 has a pipe extension 17 connected on one side. The cross connector 213 serves to provide communication between the fracturing fluid conduits 16 and their respective fracturing flow control units 15.

Figure 12:
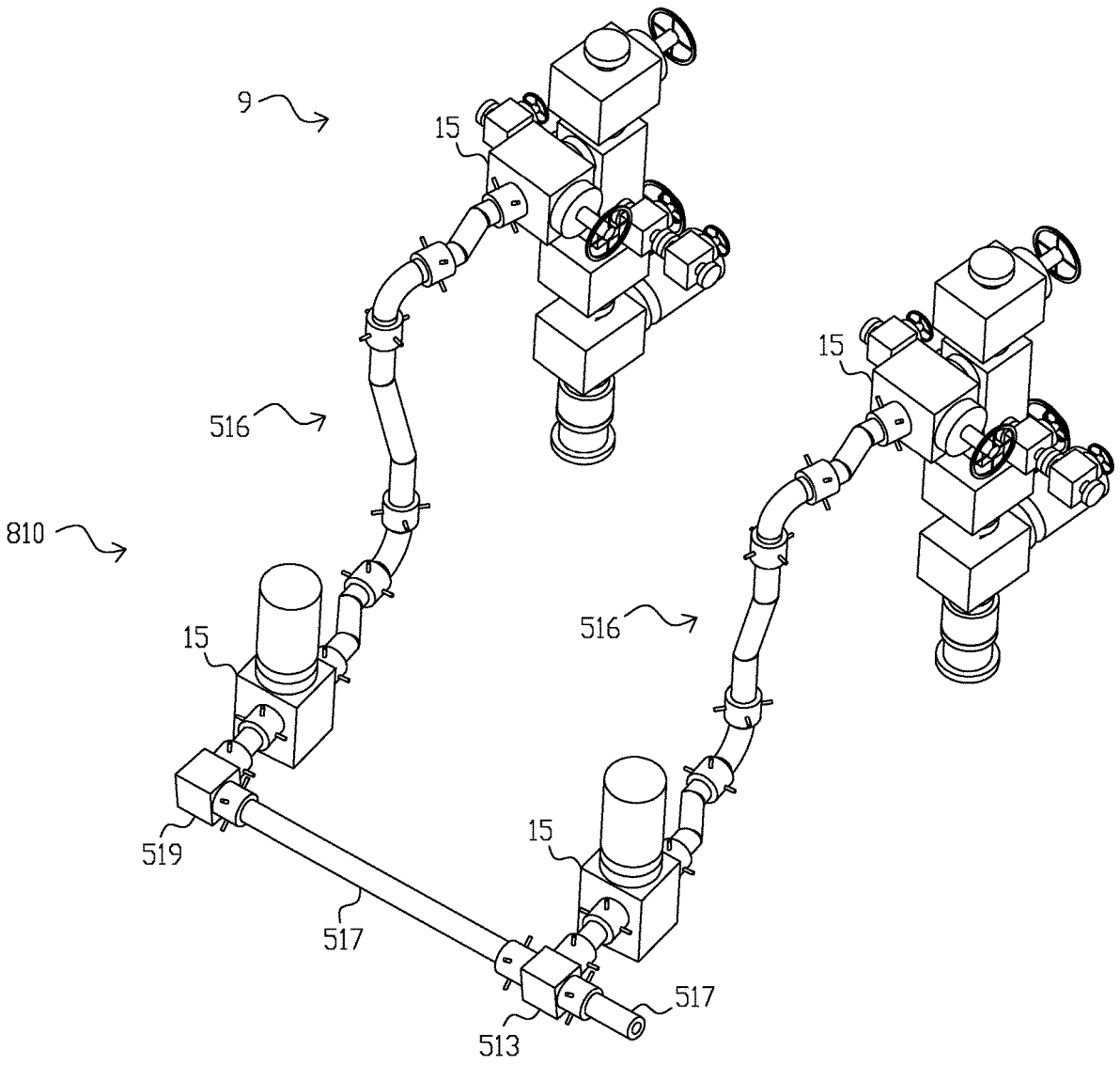
FIG. 12 is a perspective view of a well fracturing system having an adjustable well fracturing manifold with fracturing fluid conduits composed of offset pipe sections with threaded flange end connectors and angled connectors to connect between fracturing flow control units which share a threaded pipe connector with threaded angled connectors at each end, in accordance with an embodiment of the present disclosure.

Referring to FIG. 12, in this embodiment the well fracturing system 9 utilizes the same fracturing fluid conduits 516 as the well fracturing system 6 in FIG. 9, except the adjustable well fracturing manifold 810 utilizes a fracturing fluid conduit 516 to connect directly between fracturing flow control units 15. One fracturing flow control unit 15 is connected to an angled connector 519, and one fracturing fluid conduit 15 is connected to an angled tee connector 513. A pipe extension 517 couples the angled connector 519 to the angled tee connector 513. A pipe extension 517 on the opposing side of the angled tee connector 513 can be used to introduce fracturing fluid into the well fracturing system 9.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is therefore indicated by the appended claims rather than by the foregoing description. All changes that come within the meaning and range of equivalency of the claims are embraced to be within their scope.

The invention claimed is:

1. A well fracturing system, comprising: a plurality of well fracturing trees; and an adjustable well fracturing manifold coupled to each of the plurality of well fracturing trees, wherein the adjustable well fracturing manifold includes a plurality of fracturing flow control units and a fracturing fluid conduit that allows an operator to vary a dimension of the fracturing fluid conduit to facilitate coupling of the adjustable well fracturing manifold between well fracturing trees of the plurality of well fracturing trees, wherein the fracturing fluid conduit includes an offset pipe section that enables freedom of movement in aligning the adjustable well fracturing manifold between well fracturing trees of the plurality of well fracturing trees, wherein the offset pipe section has a primary bore having a primary axis and a secondary bore having a secondary axis, wherein the primary bore is parallel to the secondary bore and is rigidly connected to the secondary bore by an angled bore having a fixed angle.

2. The system of claim 1, wherein the fracturing fluid conduit includes a plurality of angled connectors, and a plurality of offset pipe sections.

3. The system of claim 2, wherein each of the plurality of fracturing flow control units is coupled to the fracturing fluid conduit via an angled connector of the plurality of angled connectors.

4. The system of claim 1, wherein the fracturing fluid conduit enables a first portion of the adjustable well fracturing manifold to be positioned with respect to a second portion of the adjustable well fracturing manifold to accommodate variation in spacing and elevation between well fracturing trees of the plurality of well fracturing trees.

5. The system of claim 1, wherein the offset pipe section can be rotated about the primary axis causing angular adjustment to the secondary axis, enabling directional adjustment to the offset pipe section.

6. The system of claim 5, wherein the offset pipe section has a rotatable connection on each end.

7. The system of claim 1, wherein the plurality of fracturing flow control units enables control of flow of fracturing fluids from the adjustable well fracturing manifold to the plurality of well fracturing trees.

8. The system of claim 1, wherein the plurality of well fracturing trees bear at least a portion of the weight of the adjustable well fracturing manifold.

9. The system of claim 1, wherein the adjustable fracturing manifold provides fracturing fluid to the well fracturing trees without the use of manifold output lines between the well fracturing manifold and the well fracturing trees.

10. A well fracturing system, comprising: a well fracturing tree; an adjustable well fracturing manifold coupled to the well fracturing tree, wherein the adjustable well fracturing manifold has one or more fracturing fluid control units to enable flow of fracturing fluid from the adjustable well fracturing manifold to the well fracturing tree via the one or more fracturing fluid control units and at least one additional well fracturing tree coupled to the adjustable well fracturing manifold by one or more additional fracturing flow control units of the at least one additional well fracturing tree; wherein the adjustable well fracturing manifold has a fracturing fluid conduit composed of a plurality of angled connectors and a plurality of offset pipe sections, wherein an offset pipe section of the plurality of offset pipe sections has a primary bore with a primary axis and a secondary bore with a secondary axis, wherein the primary bore is extending equally to the secondary bore and is solidly coupled to the secondary bore by an angled bore having a non-adjustable angle.

11. The well fracturing system of claim 10, wherein the fracturing fluid conduit is configured to enable adjustments to the position of one or more portions of the fracturing fluid conduit.

12. The well fracturing system of claim 10, wherein an offset pipe section of the plurality of offset pipe sections has a rotatable connection on each end.

13. The well fracturing system of claim 12, wherein the adjustable well fracturing manifold does not include a platform that supports a portion of the weight of the adjustable well fracturing manifold.

14. The well fracturing system of claim 12, wherein the adjustable well fracturing manifold includes a platform that supports a portion of the weight of the adjustable well fracturing manifold.

15. A method, comprising: coupling an adjustable well fracturing manifold to a first well fracturing tree to enable routing of fracturing fluid from the adjustable well fracturing manifold to the first well fracturing tree; coupling the adjustable well fracturing manifold to a second well fracturing tree adjacent to the first well fracturing tree to enable routing of fracturing fluid from the adjustable well fracturing manifold to the second well fracturing tree, wherein coupling the adjustable well fracturing manifold to the first and second well fracturing trees includes coupling fracturing flow control units of the adjustable well fracturing manifold that enable individual control of flow of fracturing fluids from the adjustable well fracturing manifold to the first and second well fracturing trees; and extend or retract the adjustable well fracturing manifold by manipulating a fracturing fluid conduit of the adjustable well fracturing manifold, wherein the fracturing fluid conduit includes a plurality of offset pipe sections whereby each offset pipe section of the plurality of offset pipe sections has a primary bore everywhere equidistant to a secondary bore, wherein the primary bore is inflexibly coupled to the secondary bore by an angled bore having a non-variable angle and a plurality of angled connectors.

16. The method of claim 15, comprising assembling the fracturing fluid conduit with connections that enable sections of the fracturing fluid conduit to rotate with respect to one another.

17. The method of claim 16, comprising fracturing a well with fracturing fluid provided from the adjustable well fracturing manifold through the first or second well fracturing tree.

* * * * *